US009045949B2

(12) United States Patent
Dobbs

(10) Patent No.: US 9,045,949 B2
(45) Date of Patent: Jun. 2, 2015

(54) FOR DOWNHOLE RECIPROCATING PUMPS, A NO TAP TOOL WITH A CLUTCH

(71) Applicant: Jerry W. Dobbs, Skiatook, OK (US)

(72) Inventor: Jerry W. Dobbs, Skiatook, OK (US)

( * ) Notice: Subject to any disclaimer, the term of this patent is extended or adjusted under 35 U.S.C. 154(b) by 0 days.

(21) Appl. No.: 14/092,326

(22) Filed: Nov. 27, 2013

(65) Prior Publication Data

US 2014/0086681 A1 Mar. 27, 2014

Related U.S. Application Data

(63) Continuation of application No. 11/504,404, filed on Aug. 15, 2006, now abandoned.

(51) Int. Cl.

| | |
|---|---|
| ***E21B 17/02*** | (2006.01) |
| ***E21B 17/07*** | (2006.01) |
| ***F04B 47/02*** | (2006.01) |
| ***F04B 53/14*** | (2006.01) |

(52) U.S. Cl.

CPC ..... *E21B 17/02* (2013.01); *Y10T 403/7073* (2015.01); *E21B 17/073* (2013.01); *F04B 47/026* (2013.01); *F04B 53/145* (2013.01)

(58) Field of Classification Search

CPC ..... E21B 17/02; E21B 17/073; F04B 47/026; F04B 53/145; Y10T 403/7073

USPC ..... 166/241.2, 105.2, 109, 68, 69, 241.3; 417/545, 547, 548, 550

See application file for complete search history.

(56) References Cited

U.S. PATENT DOCUMENTS

| | | | |
|---|---|---|---|
| 1,989,906 | A | 12/1929 | Beck |
| 2,172,602 | A | 2/1938 | Williams |
| 4,963,078 | A | 10/1990 | Agee |
| 5,950,744 | A | 9/1999 | Hughes |
| 6,068,052 | A | 5/2000 | Dobbs |
| 6,808,019 | B1 | 10/2004 | Mabry |

*Primary Examiner* — Daniel P Stephenson

(74) *Attorney, Agent, or Firm* — Gable Gotwals

(57) ABSTRACT

A tool which connects the last sucker rod of a sucker rod string to a downhole pump has a circularly cylindrical cylinder and piston so that the piston slides reciprocally and rotates freely within the cylinder. However, the closed upper end of the cylinder and the upper face of the piston have a cooperable tongue and groove which prevent relative rotational motion of the piston in the cylinder when the tongue is engaged in the groove so that the tool can be disconnected from the pump in response to rotation of the string at the uppermost stroke of the plunger to engage and turn the tongue and groove.

6 Claims, 2 Drawing Sheets

FOR DOWNHOLE RECIPROCATING PUMPS, A NO TAP TOOL WITH A CLUTCH

CROSS-REFERENCE TO PRIOR APPLICATIONS

This is a continuation patent application which claims priority to U.S. patent application Ser. No. 11/504,404, filed Aug. 15, 2006.

BACKGROUND OF THE INVENTION

This invention relates generally to equipment used in producing fluid from a well and more particularly concerns tools to enhance the operation of downhole reciprocating pumps.

U.S. Pat. No. 6,068,052, issued to the present inventor on May 30, 2000, explains the common practice and problems of "tapping" and discloses a no tap tool for downhole reciprocating pumps. That tool eliminates the need for "tapping" in the operation of a downhole pump, reduces the unidirectional application of force to the plunger of a downhole pump and allows the plunger to take the path of least resistance to overcome a "stuck" condition.

The tool is connectable between the last sucker rod of the sucker rod string and the downhole pump. A cylinder with a closed end and an internal annular seat proximate an open end houses a piston which reciprocates slidably within the cylinder and is free to rotate within the cylinder. The tool components are concentric about the longitudinal axis of the tool, so the tool components are independently free to rotate about the tool axis, allowing the plunger of the pump to rotate to the path of least resistance to achieve its freedom, thereby further reducing the forces exerted on the system components.

The freedom of the tool components to independently rotate is one of the keys to the success of this "old" tool. However, because of this freedom of the tool components to independently rotate, use of the tool in the string renders the tool and any of the equipment downhole of the tool irretrievable without retrieval of all of the equipment downhole of the tool.

It is, therefore, an object of this invention to provide a no tap tool which affords the benefits of the "old" tool. To this end, it is also an object of this invention to provide a no tap tool which utilizes independently rotating components. But, it is a further object of this invention to provide a no tap tool which does not prevent retrieval of equipment downhole of the tool.

BRIEF DESCRIPTION OF THE DRAWINGS

Other objects and advantages of the invention will become apparent upon reading the following detailed description and upon reference to the drawings in which.

Figure 1:
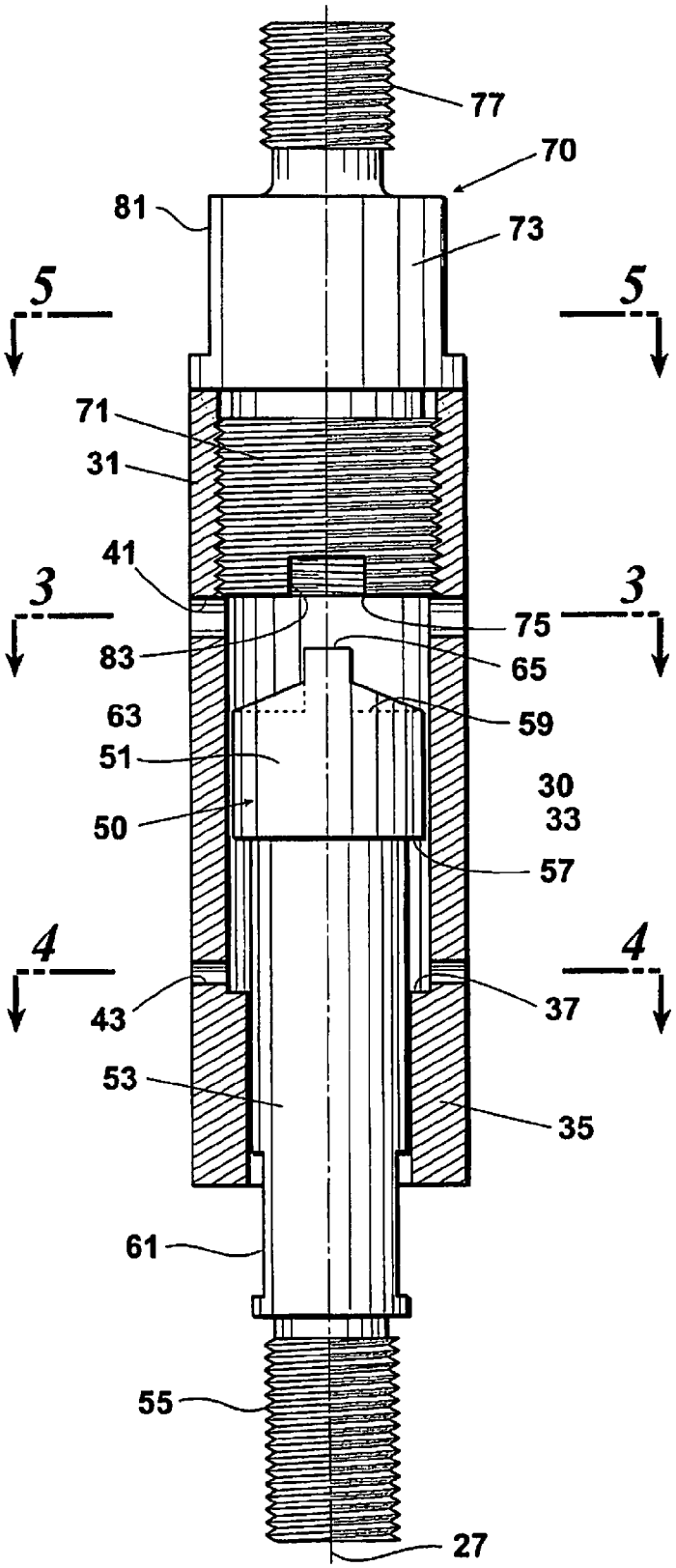
FIG. 1 is a diametric cross section of a preferred embodiment of the no-tap tool.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

SUMMARY OF THE INVENTION

In accordance with the invention, a tool is provided for connection between the last sucker rod of a sucker rod string and a downhole pump. A circular cylinder has a closed upper end which is externally adapted for connection to the last sucker rod of the sucker rod string. A circular cylindrical piston slides reciprocally and rotates freely within the cylinder. The piston has a lower portion which extends through an open lower end of the cylinder and is adapted for connection to the pump. The closed upper end of the cylinder and the upper face of the piston have a cooperable tongue and groove which prevent relative rotational motion of the piston in the cylinder when the tongue is engaged in the groove. Preferably, the tongue and groove are of rectangular cross section, are diametric in relation to the cylinder and piston and the groove is sufficiently wider than the tongue to facilitate their engagement.

In a preferred embodiment, the cylinder is concentric about a vertical longitudinal axis and has an internally threaded upper portion, a smooth middle portion and a lower portion of inner diameter less than the inner diameter of the middle portion so as to form an annular seat at a junction of the cylinder middle and lower portions. The piston is a plunger which is concentric about the vertical longitudinal axis and has an externally threaded lower portion adapted to be coupled to the pump, a smooth middle portion and a smooth upper portion with a horizontal end face and an outer diameter greater than an outer diameter of the middle portion so as to form an annular stop at a junction of the plunger middle and upper portions. The plunger upper portion slides reciprocally and rotates within the cylinder middle portion and the stop and seat are cooperable to limit the lowermost travel of the plunger upper portion within the cylinder. A pin concentric about the vertical longitudinal axis has an externally threaded lower portion with a horizontal end face engaged in the internally threaded upper portion of the cylinder, a middle portion of outer diameter greater than an inner diameter of the plunger so as to position the pin end face at the top of the cylinder middle portion when the pin lower portion is fully threaded into the cylinder upper portion and an externally threaded upper portion adapted for engagement with the last sucker rod of the sucker rod string. The pin and plunger end faces are cooperable to limit the uppermost travel of the plunger upper portion within the cylinder with the plunger lower portion extending below the cylinder lower portion. The horizontal end face of the pin has a diametric groove therein and the plunger upper portion horizontal end face has a diametric tongue thereon. The tongue and groove are cooperable to disconnect the tool from the pump in response to rotation of the string to engage and turn the tongue and groove at the uppermost stroke of the plunger.

DETAILED DESCRIPTION

Turning to FIGS. 1 through 5, the tool consists of a cylinder 30, a piston or plunger 50 and a pin 70, all concentrically aligned on a vertical longitudinal axis 27.

In the preferred embodiment shown, the cylinder 30 has an internally threaded upper portion 31, a smooth middle portion 33 and a lower portion 35. The lower portion 35 has an inner diameter less than the inner diameter of the middle portion 33 so as to define an internal annular seat 37 at the junction of the middle and lower portions 33 and 35 of the cylinder 30. At least one aperture 41 is provided through the upper side wall of the middle portion 33 of the cylinder 30, preferably substantially immediately below the top of the middle portion 33 of the cylinder 30. At least one aperture 43 is also provided through the lower side wall of the middle portion 33 of the cylinder 30, preferably substantially immediately above the internal seat 37. Preferably, four upper apertures 41 and four lower apertures 43 will be substantially equally spaced about the circumference of the cylinder 30.

The piston or plunger 50 has a smooth upper portion 51, a smooth middle portion 53 and an externally threaded lower portion 55. The outer diameter of the middle portion 53 is less than the outer diameter of the upper portion 51, thus providing a stop 57 which cooperates with the seat 37 of the cylinder 30 to limit the lowermost travel of the downstroke of the piston 50 within the cylinder 30. The length of the middle portion 53 of the piston 50 is such that the upper portion 51 of the piston 50 can reciprocate from the top to the bottom of the middle portion 33 of the cylinder 30 with the lower threaded portion 55 of the piston 50 extending below the bottom of the cylinder 30. Since the components of the cylinder 30 and the components of the piston 50 are all concentric, the piston 50 may be slidably reciprocated along the tool axis 27 and is also free to rotate within the cylinder 30 about the tool axis 27. As shown, the middle portion 53 of the piston 50 is provided with tooling flats 61.

Figure 2:
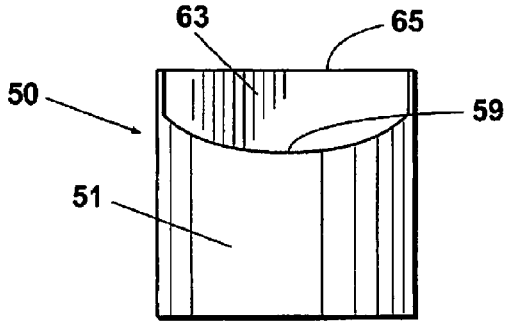
FIG. 2 is an elevation view of the upper portion of the piston of the tool of FIG. 1.

As best seen in FIGS. 1 and 2, a diametric tongue 63 extends upwardly from the upper face 59 of the piston 50. The tongue 63 shown is, looking at FIG. 1, rectangular in cross-section, but is most easily formed by use of a rotating cutter so that the upper face 59 of the piston 50 is, looking at FIG. 2, arcuate. Other cross-sections and machining methods may be used, however, and the upper face 59 of the piston 50 may be in a horizontal plane. The upper face 65 of the tongue 63 is, preferably, in a horizontal plane, as is hereafter explained.

The pin 70 has an externally threaded lower portion 71 which engages within the internal threads of the upper portion 31 of the cylinder 30. The middle portion 73 of the pin 70 has an outer diameter which is greater than the inner diameter of the upper portion 31 of the cylinder 30 so that, when the pin 70 is fully threaded into the cylinder 30, the middle portion 73 of the pin engages the upper end of the cylinder 30 and sets the horizontal lower face 75 of the pin 70 at the junction of the upper and middle portions 31 and 33 of the cylinder 30. The upper portion 77 of the pin 70 is externally threaded for engagement with a polish rod coupling at the lowermost end of the sucker rod string. The pin 70 closes the upper end of the cylinder 30 and the lower horizontal face 75 of the pin 70 is cooperable with the upper face 59 of the piston to limit the uppermost travel of the piston 50 within the cylinder 30. As shown, the middle portion 73 of the pin 70 is provided with tooling flats 81.

Figure 5:
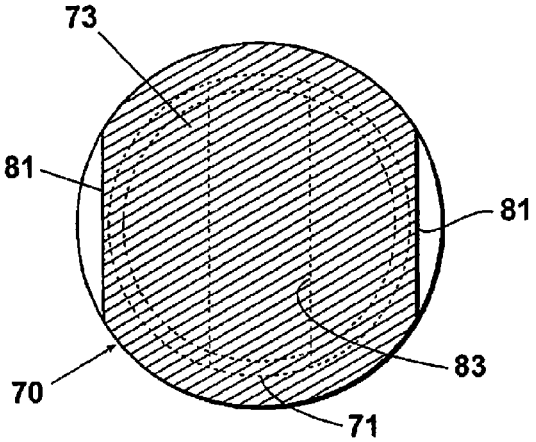
FIG. 5 is a cross-sectional view taken along the line 5-5 of FIG. 1.
Figure 3:
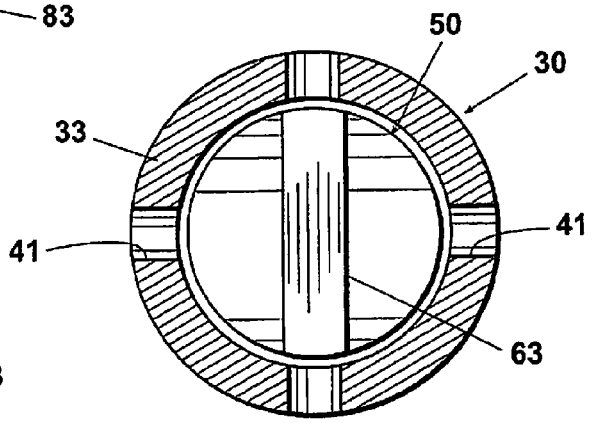
FIG. 3 is a cross-sectional view taken along the line 3-3 of FIG. 1.
Figure 4:
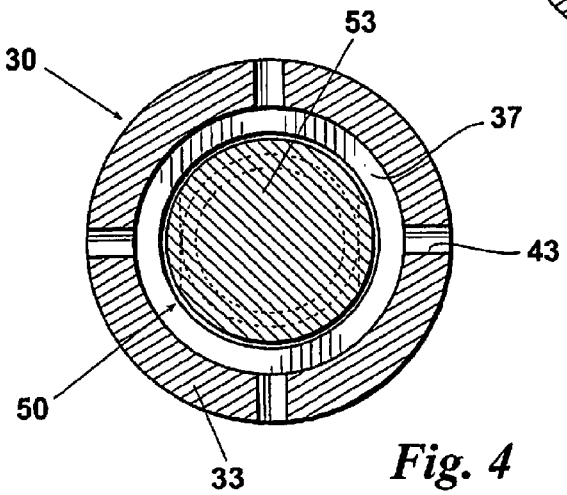
FIG. 4 is a cross-sectional view taken along the line 4-4 of FIG. 1.

As best seen in FIGS. 1 and 5, a diametric groove 83 extends upwardly into the lower horizontal face 75 of the threaded lower portion of the pin 70. The groove 83 in the pin 70 is wider than the tongue 63 of the piston 50. The difference should be sufficient to facilitate engagement of the tongue 63 in the groove 83 even if the tongue 63 is slightly flared or debris may have collected in the path of engagement.

In operation, the tool is mounted between the lowermost sucker rod and the pump. The stroke of the plunger in the pump is set so that the plunger does not strike the pump at the bottom of its stroke. However, during the reciprocation of the sucker rod string, as the cylinder 30 is reciprocated, the upper face 65 of the tongue 63 of the piston 50 strikes the lower face 75 of the pin 70 and the stop 57 of the piston 50 strikes the seat 37 in the cylinder 30, resulting in cyclical upward and downward impact on the pump plunger without impacting the pump. At the same time, the piston 50 and therefore the plunger which is attached to it, are free to rotate about the tool longitudinal axis 27, thus allowing the plunger to take the path of least resistance and resulting in minimal force being exerted on the other system components while the plunger is freed from a stuck condition.

Since the piston 50 is free to rotate in the cylinder 30, it is possible but relatively uncommon that the piston tongue 63 will align with the groove 83 in the pin 70 during normal operation of the tool. Generally, the upper horizontal face 65 of the tongue 63 will strike the lower horizontal face 75 of the pin 70. However, even if this rare event should occur, the minimal duration of any penetration of the tongue 63 into the groove 83 will have no substantial effect on the freedom of rotation during normal operation. The tool is presented as seen in FIG. 1 to illustrate the intentional alignment of the tongue 63 and groove 83 so that the tool can be disengaged from the downhole equipment for retrieval of the tool without the equipment. This is accomplished by an intentional rotation of the string and, therefore, the tool pin 70 at the top of the stroke. As the groove 83 rotates it comes into alignment with the tongue 63 and the upward inertia of the tongue 63 causes it to engage in the groove 83 and turn the tool. The opposite rotation of the string can be used as a tool is lowered to engage the tongue 63 and groove 83 and permit connection of the tool to downhole equipment.

While, in the preferred embodiment, the piston 50 extends through the open lower end of the cylinder 30, the tool could be inverted and the piston 50 adapted for connection to the sucker rod string and the pin 70 adapted for connection to the pump.

Thus, it is apparent that there has been provided, in accordance with the invention, a no-tap tool that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A tool connectable between the last sucker rod of a sucker rod string and a downhole pump comprising:

a circular cylinder having a closed upper end externally adapted for connection to the last sucker rod of the sucker rod string; and a circular cylindrical piston reciprocally slidably and rotatively disposed within said cylinder and having a lower portion extending through an opening in a lower end of said cylinder and adapted for connection to the pump;

said closed upper end of said cylinder and an upper face of said piston having a cooperable tongue and groove for preventing relative rotational motion of said piston in said cylinder when said tongue is engaged in said groove, said tongue being engagable in said groove by an intentional rotation of the string at a top of a stroke of the string until said groove rotates into alignment with said tongue and an upward inertia of said tongue causes said tongue to engage in said groove and turn therewith.

2. A tool according to claim 1, said tongue and groove being of rectangular cross section.

3. A tool according to claim 1, said tongue and groove being diametric in relation to said cylinder and piston.

4. A tool according to claim 1, said groove being wider than said tongue.

5. A tool connectable between the last sucker rod of a sucker rod string and a downhole pump comprising:

a cylinder concentric about a vertical longitudinal axis and having an internally threaded upper portion, a smooth middle portion and a lower portion of inner diameter less than an inner diameter of said middle portion so as to form an annular seat at a junction of said cylinder middle and lower portions;

a plunger concentric about said vertical longitudinal axis and having an externally threaded lower portion adapted to be coupled to the pump, a smooth middle portion and a smooth upper portion having a horizontal end face and an outer diameter greater than an outer diameter of said middle portion so as to form an annular stop at a junction of said plunger middle and upper portions, said plunger upper portion being reciprocally slidably and rotatively disposed within said cylinder middle portion and said stop and said seat being cooperable to limit a lowermost travel of said plunger upper portion within said cylinder; and a pin concentric about said vertical longitudinal axis and having an externally threaded lower portion with a horizontal end face engaged in said internally threaded upper portion of said cylinder, a middle portion of outer diameter greater than an inner diameter of said plunger so as to position said pin end face at the top of said cylinder middle portion when said pin lower portion is fully threaded into said cylinder upper portion and an externally threaded upper portion adapted for engagement with the last sucker rod of the sucker rod string, said pin and plunger end faces being cooperable to limit an uppermost travel of said plunger upper portion within said cylinder with said plunger lower portion extending below said cylinder lower portion, said horizontal end face of said pin having a diametric groove therein and said plunger upper portion horizontal end face having a diametric tongue thereon, said tongue and groove being cooperable to disconnect the tool from the pump in response to rotation of the string to engage and turn said tongue and groove at an uppermost stroke of said plunger.

6. A tool connectable between the last sucker rod of a sucker rod string and a downhole pump comprising:

a cylinder having a closed end externally adapted for connection between the last sucker rod of the sucker rod string and the pump and an internal annular seat proximate an open end thereof; and a piston reciprocally slidably and rotatively disposed within said cylinder and having a portion adapted for connection to the pump extending through said open end of said cylinder, said cylinder seat limiting travel of said piston within said cylinder in one direction of reciprocation of said piston and said closed end of said cylinder limiting travel of said piston within said cylinder in another direction of reciprocation of said piston, said closed upper end of said cylinder and an upper face of said piston having a tongue and groove cooperable to disconnect the tool from pump in response to rotation of the string to engage and turn said tongue and groove at an uppermost stroke of said plunger.

* * * * *